US008353792B2

(12) United States Patent
Arroyo

(10) Patent No.: US 8,353,792 B2
(45) Date of Patent: Jan. 15, 2013

(54) TEARDROP RING TOSSING GAME

(76) Inventor: Joe Arroyo, Fresno, CA (US)

( * ) Notice: Subject to any disclaimer, the term of this patent is extended or adjusted under 35 U.S.C. 154(b) by 245 days.

(21) Appl. No.: 12/905,926

(22) Filed: Oct. 15, 2010

(65) Prior Publication Data

US 2012/0094790 A1 Apr. 19, 2012

(51) Int. Cl.
*A63B 67/06* (2006.01)

(52) U.S. Cl. ..... 473/589

(58) Field of Classification Search ..... 473/589; 446/490, 491, 486, 487, 46, 48
See application file for complete search history.

(56) References Cited

U.S. PATENT DOCUMENTS

| | | | | | |
|---|---|---|---|---|---|
| 303,113 | A * | 8/1884 | Bradley | 473/589 |
| 2,190,816 | A * | 2/1940 | Wheeler | 343/742 |
| 3,509,642 | A * | 5/1970 | Brumlik | 434/278 |
| 3,935,668 | A * | 2/1976 | Phillips, Jr. | 446/450 |
| 4,456,265 | A * | 6/1984 | Adler | 473/589 |
| 4,560,358 | A * | 12/1985 | Adler | 446/46 |
| 5,213,539 | A * | 5/1993 | Adler | 446/48 |
| 5,234,367 | A * | 8/1993 | DeCesare | 446/48 |
| 5,374,058 | A * | 12/1994 | Janes et al. | 473/535 |
| 5,470,061 | A * | 11/1995 | Colburn et al. | 473/537 |
| 6,255,998 | B1 * | 7/2001 | Podger | 343/867 |
| 6,469,674 | B1 * | 10/2002 | Podger | 343/742 |
| 6,853,342 | B2 * | 2/2005 | Podger | 343/742 |
| 7,575,498 | B2 * | 8/2009 | Perry | 446/138 |
| 2003/0234744 | A1 * | 12/2003 | Podger | 343/742 |
| 2007/0049161 | A1 * | 3/2007 | Perry | 446/450 |
| 2012/0094790 | A1 * | 4/2012 | Arroyo | 473/589 |

OTHER PUBLICATIONS

Aerobie Orbiter Boomerang www.tealco.net/aerobie_boomerang.html (Oct. 8, 2010).

* cited by examiner

*Primary Examiner* — Raleigh W. Chiu
(74) *Attorney, Agent, or Firm* — Mark D. Miller

(57) ABSTRACT

The present invention is a ring for a game of skill, generally comprising a single strip having first and second ends, wherein said first and second ends are attached to one another to form a single endless ring having a corner on one side of said ring and a teardrop-shaped opposing side opposite said corner. In some embodiments the ring is a single continuous piece. Alternative embodiments of the present invention call for the game piece to be flexible, and for utilizing attachment mechanisms and curvature retention mechanisms to further adjust and retain the curvature of the ring, all for the purpose of affecting the trajectory of the ring when thrown.

16 Claims, 2 Drawing Sheets

TEARDROP RING TOSSING GAME

BACKGROUND OF THE INVENTION

1. Field of the Invention

The present invention relates to a game of skill played by one or more participants, and more particularly, to an apparatus and method for playing a game wherein the participants attempt to throw a ring-shaped object onto or near a designated target.

2. Description of the Prior Art

A category of games exist wherein the participants attempt to score points by throwing objects onto, or near, a designated target. The number of points earned by each participant is generally determined by the frequency with which his or her objects contact the target, or in other scenarios, by the proximity of the objects to the target. After each round of play, the participant or team best satisfying the scoring rules of the particular game (such as by having the highest number of points) is deemed the winner.

Horseshoes is one example of such a game. The objective of the game is for the participants to throw a "horseshoe" onto, or near, a stationary vertically-inclined pole. The "horseshoe" is an open-ended ring having two legs in close proximity to one another, with an open distance between the ends of the legs. When thrown, the shape of the "horseshoe" causes it to travel in a "smooth" trajectory (generally symmetrical on both sides of a vertical axis centered at the trajectory apex, and having progressive changes in altitude along the length of such trajectory), while rotating in a circular manner around its center point. The greatest number of points is scored if the "horseshoe" is thrown around the pole, although points are also scored for touching the pole, or landing in close proximity thereto.

Another example is the carnival game of tossing circular rings and attempting to cause them to encircle the top of one of many bottles or other upstanding objects. When tossed toward the target, the spherical shape of the ring causes it to travel in a smooth trajectory. Points are scored, or prizes are won, if the ring stays on the upstanding object.

Other games provide variations of the same concept, wherein objects thrown by the participants must contact, or land in close proximity to, the target. Depending upon the particular game, these objects travel in one of two common trajectories—a trajectory (such as when balls or beanbags are tossed in an underhanded fashion) or a generally horizontal trajectory (such as the projection of arrows and darts, wherein the velocity of the object and the proximity of the target allow for minimal gravitational effects).

However, the limited variations of these trajectories allow participants of one game to gain a certain level of proficiency in a similar game within a short period of time. This ease of proficiency may quickly lead to boredom and a decreased desire to continue playing such games. In addition, the smooth trajectories provided by rings or horseshoes often make it difficult to cause them to land such that they encircle the intended upstanding object.

It is therefore desirable to provide new or different features for such games in order to stimulate or revitalize interest therein.

It is also desirable to provide a throwable object that provides a unique trajectory that is more conducive to landing on and encircling an upstanding object.

SUMMARY OF THE INVENTION

The present invention is an endless ring having a generally teardrop, lemniscates or piriform shape, a point or corner therein, and an oppositely positioned elliptical shape. Since a single corner is provided, the angle of this corner is often, but not always, determined by the length of the ring. The particular curvature of one side will directly affect the curvature of the opposite and adjacent sides.

In its most basic embodiment, the present invention generally comprises a single elongate strip of material, wherein the two ends of the strip are attached to one another. The two ends of the strip form a corner or joint, and the remainder of the strip forms the elliptical ring. The corner may be secured by any one or combination of devices for temporarily or permanently securing two objects to one another, such as a weld or adhesives, or alternatively, the present invention may be formed from a single, continuous piece of material.

One alternative embodiment of the present invention utilizes an adjustable end attachment mechanism, to which the two ends of the strip are attached. The adjustable end attachment mechanism may comprise multi-position interlocking latches or hinges, one or more interchangeable or interlocking plates, or any other commonly available mechanism for securing the ends of the strip and adjusting the angle of the corner formed by said ends. Said adjustable end attachment mechanism allows participants to adjust the angle at which the two strip ends meet, and thereby adjust the shape of the ring.

Another alternative embodiment of the present invention utilizes a flexible strip constructed from bendable plastics, rubber, thin metals or other flexible materials, and a curvature retention mechanism for adjusting the curvature of one or more portions of the body, and retaining the curvature once adjusted. The curvature retention mechanism may comprise a flexible or inflexible tube, movable or expandable slides, multi-position interlocking latches or hinges, one or more interchangeable or interlocking plates, or any other commonly available mechanism for fixing the curvature of the present invention. Alternatively, said curvature may be retained without a separate curvature retention mechanism by utilizing a flexible strip that is capable of retaining its shape once formed.

The purpose of these adjustments, either to the angle at which the two ends of the strip meet, or to the curvature of the present invention, is to allow participants to affect the trajectory of the present invention when the present invention is thrown. This allows participants to utilize trajectories other than the two traditional trajectories described above. It is to be appreciated that the present invention may utilize features from one or both, or none, of the alternative embodiments, as well as other features.

It is therefore an object of the present invention to provide new or different features for ring-throwing games in order to stimulate or revitalize interest therein.

It is a further object of the present invention to allow players to affect the trajectory of a thrown ring by adjusting the shape or length of the ring.

It is a further object of the present invention to provide a throwable object that flies according to a unique trajectory that is more conducive to landing upon, and encircling, an upstanding object.

Additional objects of the invention will be apparent from the detailed descriptions and the claims herein.

DETAILED DESCRIPTION

Figure 1A:
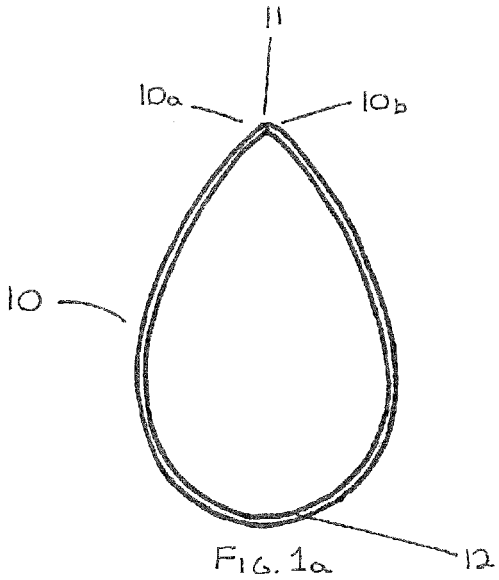
FIG. 1*a* is an illustration of the basic embodiment of the present invention.

Referring to the drawings wherein like reference characters designate like or corresponding parts throughout the several views, and referring particularly to FIG. 1*a*, it is seen that the present invention, in its most basic embodiment, comprises a single strip of material 10, wherein the two ends of the strip 10*a* and 10*b* are attached to form corner 11. The two ends 10*a* and 10*b* forming corner 11 may be secured by any one or combination of methods, such as a weld or adhesives. The remainder of the strip 10 forms an elliptical ring with an opposing side 12 opposite the corner 11. In other embodiments, the game piece of the present invention may be made of a continuous, integrated piece of material having an open center and at least one angled corner.

It should be appreciated that the particular angle of the corner 11 will affect the curvature of the present invention. For example, if corner 11 is narrowly angled, as depicted in FIG. 1*a*, the opposing side 12 will have a tighter curvature. On the other hand, if corner 11 is widely angled, the opposing side 12 will have a broader curvature.

Figure 1B:
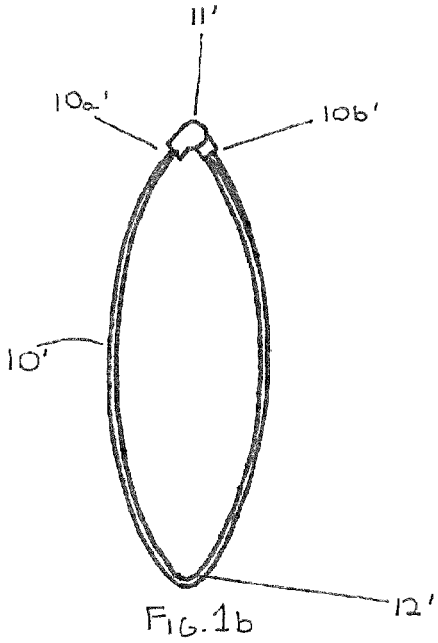
FIG. 1*b* is an illustration of an alternative embodiment of the present invention, utilizing an adjustable end attachment mechanism.

FIG. 1*b* depicts an alternative embodiment of the present invention, comprising a flexible strip 10' and an adjustable end attachment mechanism 11'. The adjustable end attachment mechanism 11' comprises a multi-position interlocking latch or hinge that allows participants to adjust the angle of the mechanism 11'. As with the basic embodiment described above, a narrow angle for mechanism 11', as depicted in FIG. 1*b*, will result in a tighter curvature for opposing side 12' if opposing side 12' has a lower tensile strength than the remainder of the strip 10', while a wider angle for mechanism 11' will result in a broader curvature for opposing side 12'. The flexibility of strip 10', and the use of a multi-position mechanism 11', will allow the present invention to take on any number of shapes, e.g., an oval-like shape with various degrees of curvature along its body if the arms of mechanism 11' (which receive strip ends 10*a*' and 10*b*') are placed at various acute angles relative to one another, an oval-like shape with a partially straight side if the arms of mechanism 11' are placed 180 degrees relative to one another, or a heart-like shape if the arms of mechanism 11' are placed at an obtuse angle relative to one another.

Figure 1C:
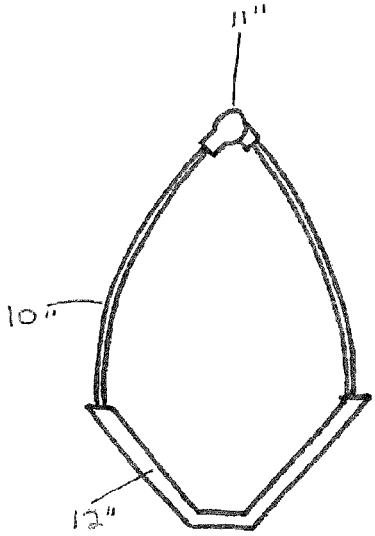
FIG. 1*c* is an illustration of an alternative embodiment of the present invention, utilizing a curvature retention mechanism to fix the curvature of the present invention.

FIG. 1*c* depicts yet another alternative embodiment of the present invention, comprising a flexible strip 10", an adjustable end attachment mechanism 11", and a curvature retention mechanism 12". In this particular embodiment, the curvature retention mechanism 12" comprises an inflexible tube through which the flexible strip 10" is threaded, and which causes the curvature of the present invention to conform to the shape of the curvature retention mechanism 12". Additional or alternate curvature retention mechanisms 12" of different shapes and lengths may be utilized to further define the shape of the present invention. It should be appreciated that a single flexible or otherwise adjustable curvature retention mechanism 12" may be utilized in lieu of multiple curvature retention mechanisms, or alternatively, that a curvature retention mechanism 12" may be unnecessary if the flexible strip 10' retains its shape once formed.

Figure 2A:
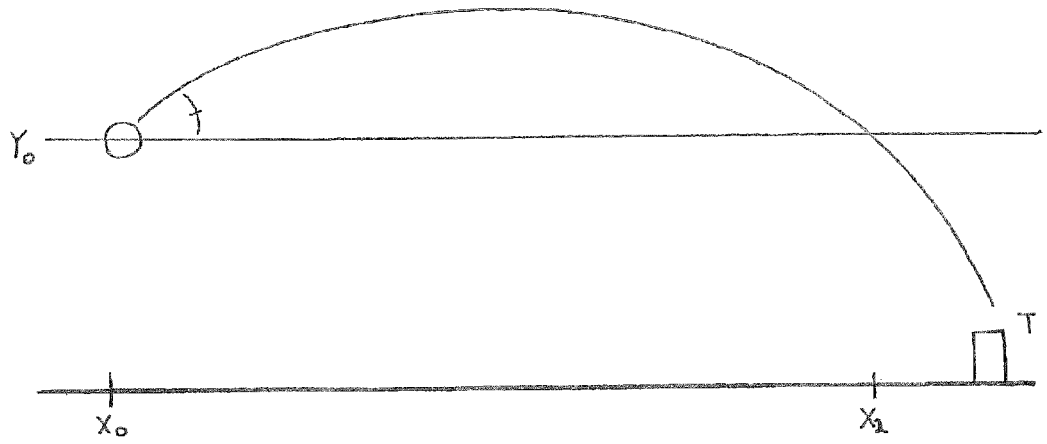
FIG. 2a (Prior art)
FIG. 2*a* is an illustration of a common trajectory used when an object, such as a ball or beanbag, is tossed in an underhanded fashion.

The shape of the proposed invention causes it to travel at a modified trajectory when thrown by the participant. Such modification is best demonstrated by comparing the trajectory of the proposed invention to the trajectory of the prior art. FIG. 2*a* depicts the trajectory of a softball. A participant stands at location $x_0$, and holds the softball at a vertical height of $y_0$. When the softball is tossed toward the target T at a certain angle and trajectory, it travels along a smooth trajectory (with due consideration for gravity), crossing the vertical plane $y_0$ again at location $x_2$. It maintains a predictable trajectory until it contacts or falls near the target T.

Figure 2B:
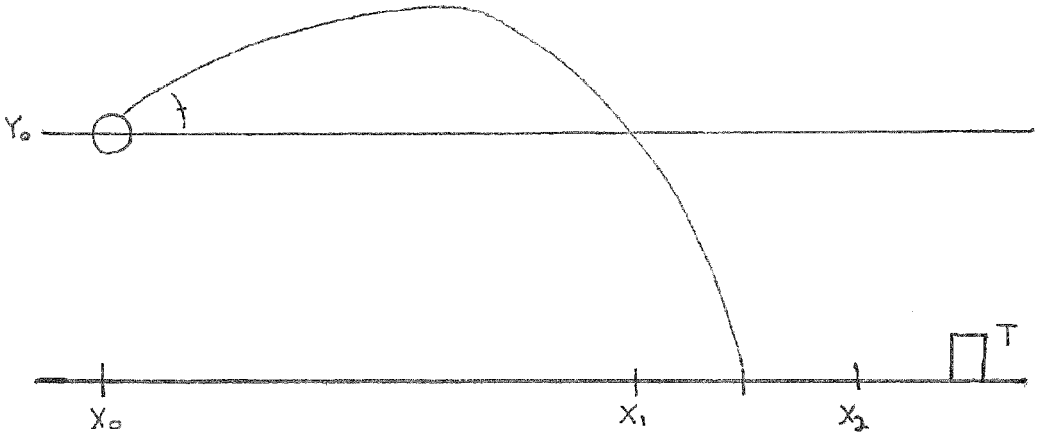
FIG. 2*b* is an illustration of one possible trajectory of the present invention.

FIG. 2*b* depicts the modified trajectory of the present invention, wherein the present invention is in the form generally depicted in FIG. 1*a*. A participant stands at the same location $x_0$, and holds the present invention at the same vertical height of $y_0$. The invention is tossed toward the target T, with or without an axial rotation, at the same angle and velocity as described with respect to FIG. 2*a*. It begins its arc along the same trajectory depicted in FIG. 2*a*. However, the shape of the present invention, and its rate of axial rotation, causes it to fall short partway through the previous trajectory, resulting in an intersection of vertical plane $y_0$ at location $x_1$, rather than at location $x_2$.

Thus, in order to contact target T with the present invention, the participant must adjust his or her throwing trajectory to compensate for the sudden drop caused by the shape of the present invention. As the timing and location of the drop will depend upon the shape of the present invention as it is used during that particular play, the participants must be able to determine the timing of the drop based upon the shape of the invention. A participant skilled with tossing a softball (with the trajectory generally depicted in FIG. 2*a*) will not necessarily have an advantage when tossing the present invention, as there may be many varying potential trajectories based upon the particular shape of the invention during that particular play. Furthermore, such a drop may be advantageous in the playing of carnival or other games in that the present invention may be thrown such that it neatly drops over an upstanding object.

In use, participants in a game utilizing the present invention as depicted in FIG. 1*c*, would position the arms of the adjustable end attachment mechanism 11' at an angle determined in any number of ways, e.g. randomly, according to a particular playbook, or by a consensus of the participants. The participants would also attach a curvature retention mechanism 13 to the opposing side 12. Upon preparing the present invention in such a manner, the participants will commence the game using the particular rules established for that game, which may comprise the commonly known rules for horseshoes, the carnival ring toss game, or any other number of games.

It is to be understood that other variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A game piece comprising a flat strip of material that is bendable in a first plane but not bendable in a second plane perpendicular to said first plane, said strip having opposite ends that are attached to each other at a corner forming a continuous piece having an open interior.

2. The game piece of claim 1 wherein said game piece has a generally piriform cross-sectional shape.

3. The game piece of claim 1 wherein the cross-sectional form of said game piece is generally teardrop shaped.

4. The game piece of claim 1 wherein said game piece has a generally lemniscates cross-sectional shape.

5. A game piece comprising a continuous piece of thin material that is deformable in a first plane but not deformable in a second plane perpendicular to said first plane, said continuous piece having a corner therein having an interior angle of less than about one hundred degrees, said piece having an open interior.

6. A game piece comprising an elongate strip having a first end attached to a second end at a petal point, wherein the interior angle of said petal point is less than ninety degrees and said game piece has an about lemniscates shape.

7. The game piece of claim 6, wherein the center of gravity of said game piece is at a different location than the geometric center of said game piece.

8. The game piece of claim 6, wherein said strip is deformable to adjust the interior angle of said petal point.

9. The game piece of claim 8, wherein the deformability of said strip at the side opposite to said petal point is greater than the normal deformity of said strip.

10. The game piece of claim 6, further comprising at least one attachment mechanism to secure said first end of said strip to said second end of said strip.

11. The game piece of claim 10, wherein said attachment mechanism comprises a joint.

12. The game piece of claim 11, wherein said attachment mechanism comprises at least one ball and socket connection.

13. The game piece of claim 10, wherein said attachment mechanism comprises a first receptacle and a second receptacle for receiving said first end and said second end of said strip, respectively.

14. The game piece of claim 6, further comprising at least one curvature retention mechanism.

15. A method for assembling a piece for use in a game of skill comprising the steps of:

positioning first and second receptacles of an attachment mechanism at opposite ends of a game piece comprising a flat strip of material that is bendable in a first plane but not bendable in a second plane perpendicular to said first plane; and inserting said opposite ends of said strip into said first and second receptacles to form a game piece having a curvature.

16. The method of claim 15, further comprising the step of affixing at least one curvature retention mechanism to said game piece to retain the curvature of said game piece.

* * * * *